US006612501B1

(12) United States Patent
Woll et al.

(10) Patent No.: US 6,612,501 B1
(45) Date of Patent: Sep. 2, 2003

(54) COMPUTER GAME AND METHOD OF PLAYING THE SAME

(75) Inventors: Cynthia Woll, San Mateo, CA (US); Lisa Strom, Redondo Beach, CA (US); Alan Cusolito, Aliso Viejo, CA (US)

(73) Assignee: Mattel, Inc., El Segundo, CA (US)

( * ) Notice: Subject to any disclaimer, the term of this patent is extended or adjusted under 35 U.S.C. 154(b) by 87 days.

(21) Appl. No.: 09/616,464

(22) Filed: Jul. 14, 2000

Related U.S. Application Data

(60) Provisional application No. 60/143,922, filed on Jul. 14, 1999.

(51) Int. Cl.[7] ..... G06K 19/06

(52) U.S. Cl. ..... 235/494; 235/381; 235/380; 235/375

(58) Field of Search ..... 235/494, 375; 273/138.2, 138.1

(56) References Cited

U.S. PATENT DOCUMENTS

| | | | | |
|---|---|---|---|---|
| 4,882,473 A | * | 11/1989 | Bergeron et al. | 235/375 |
| 5,026,058 A | | 6/1991 | Bromley | |
| 5,069,453 A | | 12/1991 | Koza et al. | |
| 5,112,050 A | | 5/1992 | Koza et al. | |
| 5,212,368 A | | 5/1993 | Hara | |
| 5,411,259 A | | 5/1995 | Pearson et al. | |
| 5,533,124 A | | 7/1996 | Smith et al. | |
| 5,548,110 A | | 8/1996 | Storch et al. | |
| 5,689,561 A | | 11/1997 | Pace | |
| 5,708,422 A | | 1/1998 | Blonder et al. | |
| 5,709,603 A | | 1/1998 | Kaye | |
| 5,743,801 A | | 4/1998 | Welander | |
| 5,749,075 A | | 5/1998 | Toader et al. | |
| 5,774,869 A | | 6/1998 | Toader | |
| 5,791,990 A | * | 8/1998 | Schroeder et al. | 273/138.2 |
| 5,816,918 A | | 10/1998 | Kelly et al. | |
| 5,864,604 A | | 1/1999 | Moen et al. | |
| 5,902,353 A | | 5/1999 | Reber et al. | |
| 5,903,729 A | | 5/1999 | Reber et al. | |
| 5,986,651 A | | 11/1999 | Reber et al. | |
| 6,012,984 A | * | 1/2000 | Roseman | 463/1 |
| 6,015,344 A | | 1/2000 | Kelly et al. | |
| 6,028,920 A | | 2/2000 | Carson | |
| 6,061,656 A | | 5/2000 | Pace | |
| 6,080,062 A | | 6/2000 | Olson | |
| 6,102,406 A | * | 8/2000 | Miles et al. | 273/430 |
| 6,173,267 B1 | | 1/2001 | Cairns | |
| 6,278,980 B1 | | 8/2001 | Wendkos | |
| 6,308,991 B1 | * | 10/2001 | Royer | 235/100 |
| 6,347,794 B2 | * | 2/2002 | Scrymgeour et al. | 273/138.1 |

FOREIGN PATENT DOCUMENTS

| | | | |
|---|---|---|---|
| GB | 2147773 A | | 5/1985 |
| JP | 10222522 | | 8/1998 |
| JP | 02001113043 A | * | 4/2001 |

* cited by examiner

*Primary Examiner*—Thien M. Le
*Assistant Examiner*—Allyson Sanders
(74) *Attorney, Agent, or Firm*—Kolisch Hartwell, P.C.

(57) ABSTRACT

A method of playing a computer game and the game itself, using a computer and a plurality of collectible trading cards that each has a unique code that is hidden under a removable coating. The game may be played by removing the coating from one of the trading cards and inputting the unique code on that card into a computer program or web site. The unique code may be linked with an associated computer output such as a web page within the web site. Inputting of the unique code renders the unique code inoperable for subsequent use by the computer program.

30 Claims, 4 Drawing Sheets

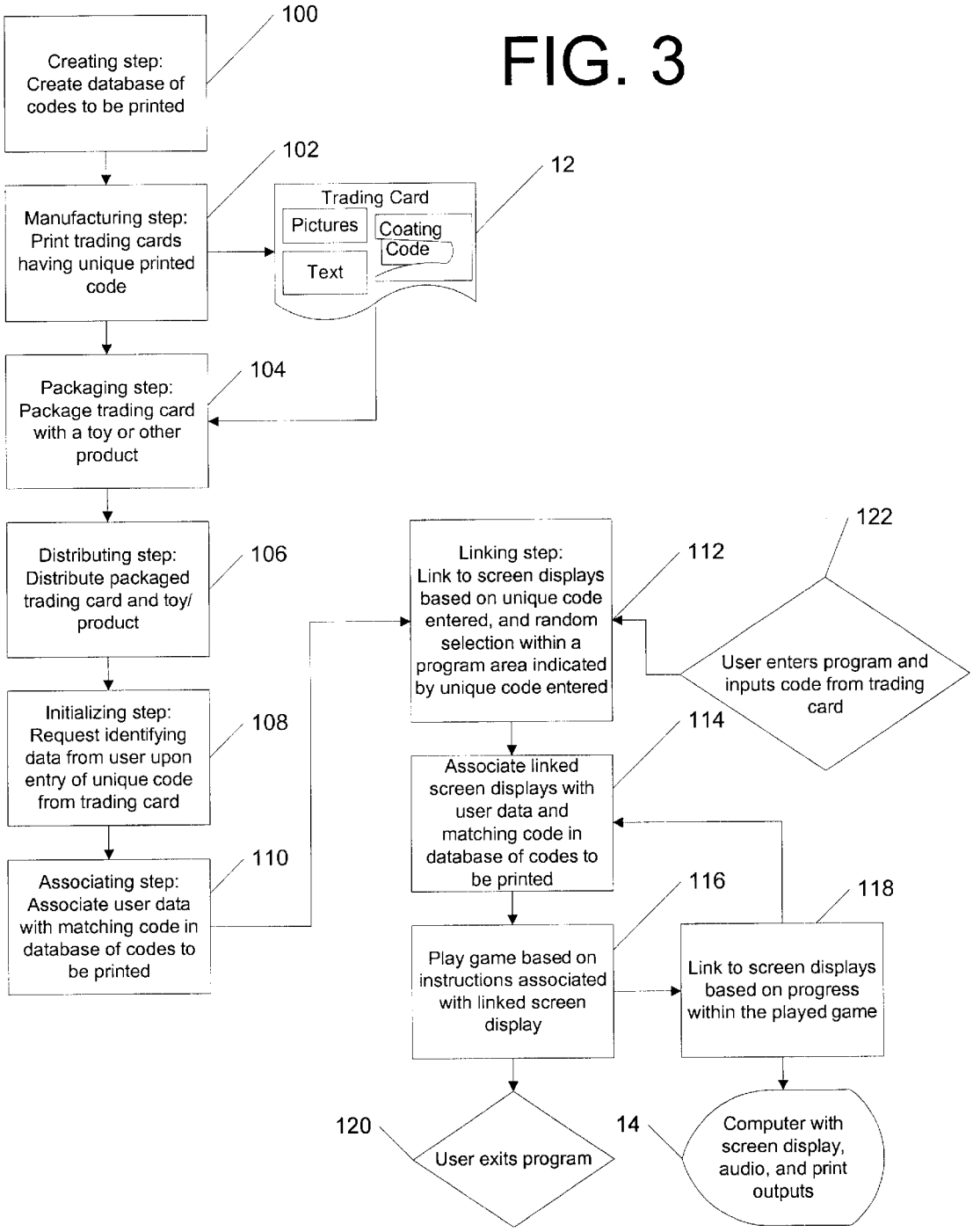
FIG. 3
100
Creating step: Create database of codes to be printed
102
Manufacturing step: Print trading cards having unique printed code
12
Trading Card
Pictures
Coating
Code
Text
104
Packaging step: Package trading card with a toy or other product
106
Distributing step: Distribute packaged trading card and toy/ product
108
Initializing step: Request identifying data from user upon entry of unique code from trading card
110
Associating step: Associate user data with matching code in database of codes to be printed
112
Linking step: Link to screen displays based on unique code entered, and random selection within a program area indicated by unique code entered
122
User enters program and inputs code from trading card
114
Associate linked screen displays with user data and matching code in database of codes to be printed
116
Play game based on instructions associated with linked screen display
118
Link to screen displays based on progress within the played game
120
User exits program
14
Computer with screen display, audio, and print outputs

COMPUTER GAME AND METHOD OF PLAYING THE SAME

This application claims priority to U.S. Provisional Patent Application Ser. No. 60/143,922, which was filed on Jul. 14, 1999, of Cynthia Woll, Lisa Finnochiaro, and Alan Cusolito for a COMPUTER GAME AND METHOD OF PLAYING THE SAME.

BACKGROUND AND SUMMARY OF THE INVENTION

The present invention relates generally to computer games and methods of playing computer games, and more specifically to computer games and methods that use trading-style cards. The trading cards have a unique code, which is used by a computer program to control access to portions of the computer program.

The use of trading cards in connection with computer programs is disclosed in U.S. Pat. Nos. 5,662,332, 5,743,801, 5,864,604, 5,902,353, 5,026,058, 5,212,368, 5,411,259, 6,061,656, 5,743,801, 5,689,561 and 5,903,729, and different types of trading cards are disclosed in U.S. Pat. Nos. 4,822,043, 5,417,431, 5,494,445, 5,687,087, 5,689,561, and 5,695,346. The disclosures of all of these patents are incorporated herein by reference.

The trading cards for use with the present computer game may be sold separately or sold packaged with another product, such as a toy animal. At least some of the trading cards are printed with a unique identifying number, which a user of the card may use as an access code for the computer program. There may be as many unique identifying numbers as there are cards, and there may also be several different identifying numbers printed on a single card.

Preferably, at least some of the identifying numbers are covered or obscured from view by a removable coating, so that the identifying number can be seen only by removing the coating. The removal coating may be designed so that it is damaged or no longer present on the card once it is been removed, similar to scrabble coatings and tamper-evident packaging. The use of a removable coating on the trading card allows traders of the card to determine whether anyone may have used the identifying number on any particular card because a card on which the coating has been removed is likely to have been used with a computer program. As described in more detail below, the cards have more value to a player of the computer program if the identifying number has not been used.

For example, when a user has removed the removable coating from a trading card, the identifying number that was covered by the removable coating may be entered into a computer program. If the computer program is designed so that certain aspects of the program are accessible only when particular identifying numbers are entered, access to particular identifying numbers provides extra value to a user of the computer program. A user of the computer program may, therefore, want to obtain additional unique identifying numbers, either by purchasing additional cards, or by trading with others who may have such cards.

The computer program may track whether one or more of the identifying numbers has been entered, and may modify future operation of the program so that reentry of any particular identifying number does not provide any additional benefit to any user. One way of doing this is to track the identifying numbers in a database, and modify a field of the database or delete the identifying number from the database to indicate that a particular identifying number has been entered by a user. Alternatively, identifying numbers may be added to a database only when entered by a user of the program. Each time an identifying number is entered by any user, the computer program would access the appropriate database, and determine whether that identifying number had been entered previously.

The identifying numbers may be created and tracked by the computer program, or created outside of the computer program and then communicated to the computer program in the form of a database of codes, or a set of rules for interpreting codes. Preferably, the identifying numbers would be non sequential, include random quantities of numerals and letters, and be created so that it is difficult to guess any particular number that may be functional for any particular computer program. Thus, it is difficult for someone to enter a random number into the computer program to obtain the benefit of that number, because it is unlikely that any particular number is even part of the series of the identifying numbers used by the program. This makes it more likely that users of the program acquire cards for use with a program, and not circumvent the purpose of the trading cards.

The computer program may be implemented as part of an Internet web site, but it may also be implemented as a stand-alone program or local area network. A user of the program typically would enter a user name and password each time that user accesses the program. This information may be stored in tracked by the program so that the user may save and later resumed resume play of the game at a time, and may continue to access the portions of the program provided by earlier entry of particular identifying numbers.

The portions of the program that are accessed by entry of a particular identifying number may simply be links to an associated screen display or web page within the computer program or web site. As a user obtains new trading cards with new identifying numbers, the user may enter them into the program. The user may be taken randomly to a new display or new page within the web or program each time the user enters a new identifying number. Each new identifying number may provide a different screen display, audio clip, printout, and/or video or movie clip. Therefore, the user's experience may change as each new code is entered.

Alternatively, some of the identifying numbers may give the user a special power within the program. For example, if the program is a battle simulation game, a character within the program may acquire additional weapons or skills. If the user then returns to previously accessed portions of the program, play of the game within those portions of the program may be changed as well.

The screen displays or web pages may be offered in random order so as to create a customized feel for each user. The progress of each user may be tracked by a database by user name and password, so that a user may return to a previously played portion of the program, as discussed above, or may access additional portions of the program as a reward for the progress made by the user, without requiring additional identifying numbers. Furthermore, there may be a cumulative benefit to collecting the trading cards. Once the user has entered a predetermined number of identifying numbers, access may be provided to yet additional portions of the computer game.

The advantages of the present invention may be understood more readily after a consideration of the drawings and the Detailed Description of the Preferred Embodiment.

BRIEF DESCRIPTION OF THE DRAWINGS

FIG. 3 is a flow chart of a game and method according to the present invention.

DETAILED DESCRIPTION OF THE PREFERRED EMBODIMENT

Figure 1:
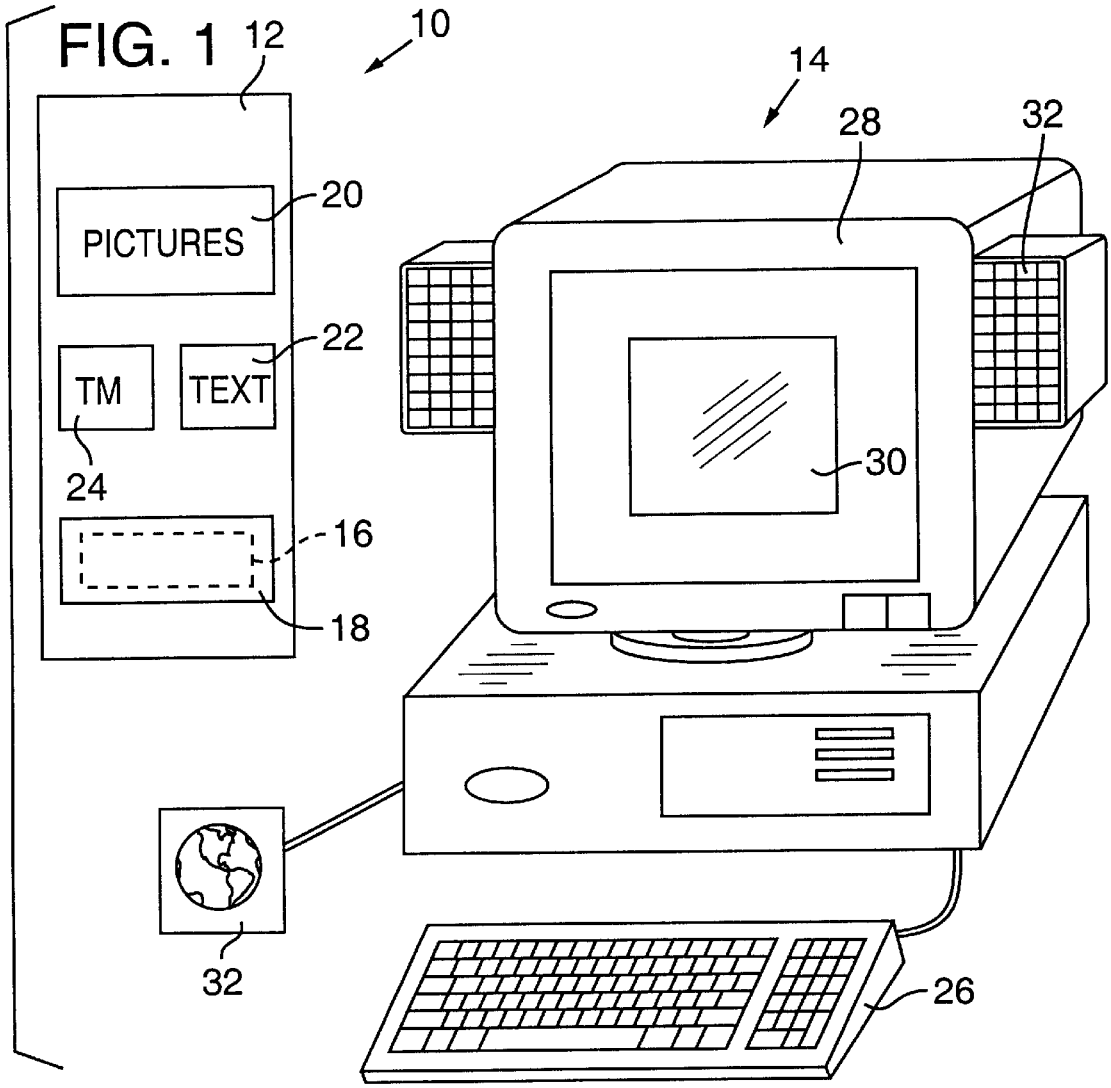
FIG. 1 is a schematic diagram of the equipment used in the present invention.

The equipment of a trading-card-based computer game 10 is shown generally in FIG. 1. Game 10 includes a trading card 12 and a computer 14, as shown in FIG. 1. Trading card 12 may be a collectible item.

Trading card 12 has a unique code 16 printed onto the card. Unique code 16 may be an alphanumeric code that a computer program may recognize. The code provides access to portions of computer game 10. Code 16 may be human readable, or it may be machine readable as in a barcode or data disk. Moreover, code 16 may be printed such that it can only be read by using a colored film that will delineate code 16 from the background print.

Figure 2:
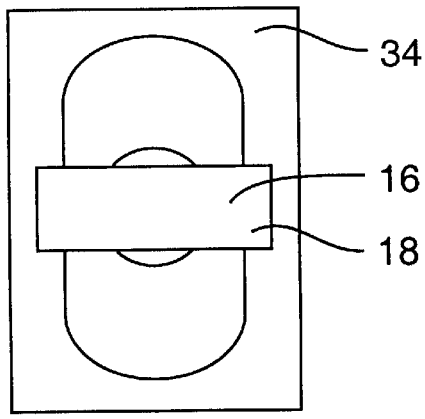
FIG. 2 is an alternative embodiment of a trading card represented in FIG. 1

A removable coating 18 covers unique code 16 on trading card 12. Removable coating 18 operates as a security coating identifying when a unique code 16 on a trading card 12 may have been used in play of game 10. For example, removable coating 18 may be a scratch off coating such as is found on lottery scratch off cards, as shown in FIG. 1. Alternatively, removable coating 18 may be a packaging that obscures unique code 16 from immediate view, as shown in FIG. 2. For either of these embodiments, code 16 is readable after coating 18 is removed.

Trading card 12 may also contain pictures 20, text 22, and/or trademarks 24 which may add collector value to the cards. Pictures 20 and text 22 may relate to a product in connection with computer game 10 or may represent characters used in computer game 10.

Trading card 12 as shown in FIG. 1 is in a printed form. However, there is no limitation that trading card 12 be a traditional trading card. For example, a disk format trading card 36, as shown in FIG. 2, is also contemplated. Card 36 includes machine readable data, and may also include printed graphics. Examples of this type of card are disclosed in U.S. Pat. Nos. Des. 193,785 and 5,090,561, the disclosures of which are incorporated herein by reference.

Unique code 16 is inputted to computer 14 through an input device 26. Input device 26 may be a keyboard, but other devices could be used, including a barcode reader and a CD-ROM drive. Game play based on unique code 16 is displayed on a display monitor 28 connected to computer 14. Computer output 30 result from input of unique code 16. Audio output from speakers 32 may also result from input of unique code 16. Computer game 10 may be played through the Internet 34 by accessing an associated web site.

A flow chart representing the method of playing game 10 is shown generally in FIG. 3. This method may include a creating step 100, a manufacturing step 102, a packaging step 104, a distributing step 106, an initializing step 108, an associating step 110, a linking step 112, and various game playing steps 114, 116, 118, 120.

Manufacturing step 102 includes printing and providing trading cards 12 where at least one card 12 has at least one unique code 16 on it. Optionally, packaging step 104 is possible where trading cards 12 may be packaged with a marketable good, such as a toy or other consumer product, creating a packaged assembly.

Distributing step 106 may include distributing trading card 12 to users. Optionally, if packaging step 104 was implemented, distributing step 106 may include selling or distributing the packaged assembly. The packaged assembly or trading card 12 may be distributed through various distribution methods, such as retail sales, direct marketing, and promotional giveaways. Furthermore, trading card 12 may be distributed without any particular toy or other product. Trading card 12 also may be transmitted electronically, such as by fax or e-mail.

Distributing step 106 includes distributing cards to potential users of computer game 10. Distributing step 106 is not limited to a retail distribution market. The value of trading card 12 may depend on pictures 20 or text 22 on the card, but may also depend on whether removable coating 18 is intact. Trading card 12 with coating 18 removed identifies the card as likely to have been used. Users may prefer a trading card 12 that has not been used by removing coating 18, since use of unique code 16 may render it inoperative for a second user. Hence, the value of trading card 12 with coating 18 removed may be decreased.

Initializing step 108 is where the user inputs unique code 16 into computer 14. Moreover, in initializing step 108, the program may request identifying data from the user after entry of unique code 16 from trading card 12. The identifying data may include personal identification from a user such as name, address, age, education, and other statistical personal data. The personal identification may be stored in the computer program becoming part of the database component. The program may also allow a password to be created by the user where the user in subsequent games can store progress of an earlier version of computer game 10.

Associating step 110 may be performed after entry of code 16. Computer program 10 associates entered code 16 with a database of codes. Computer program 10 may have a field of available codes, which may include codes that are being inputted for a first time. The availability field has codes 16 which are valid and operative. The database may also contain a field of unavailable codes that are inoperative. The codes may be inoperative due to prior use.

Linking step 112 links code 16 with associated computer output 30. If computer game 10 is a website, computer output 30 may be a different web page within the website. Computer output 30 may be associated with identifying data, such that progress of the user within computer game 10 may be tracked and stored. Preferably, these links are implemented through hypertext linking on the Internet.

Game playing steps 114, 116, 118, 120 proceed based upon instructions associated with a linked computer output 30 from code 16. Computer output 30 may be various outputs, including video clips or audio files. At some stages within play of computer game 10, audio data may be transmitted and outputs may be directed through speakers 32. Outputs may also include printouts.

Additional links may be generated by the program or requested by the user, as shown at step 118, in which a link to computer output 30 is based on progress within the played game.

As the user continues to play the game, game-playing steps 114, 116, and 118 may be repeated. Play of the game may end, temporarily or permanently, upon a user exiting the program, at 120. If the user later decides to resume play of computer game 10, the user enters the program and inputs personal identification and/or new or previously entered codes from trading cards 12, at 122. The computer program may retrieve a prior computer output 30. Linking step 112 is activated and game playing steps 114, 116, and 118 as discussed above.

Figure 4:
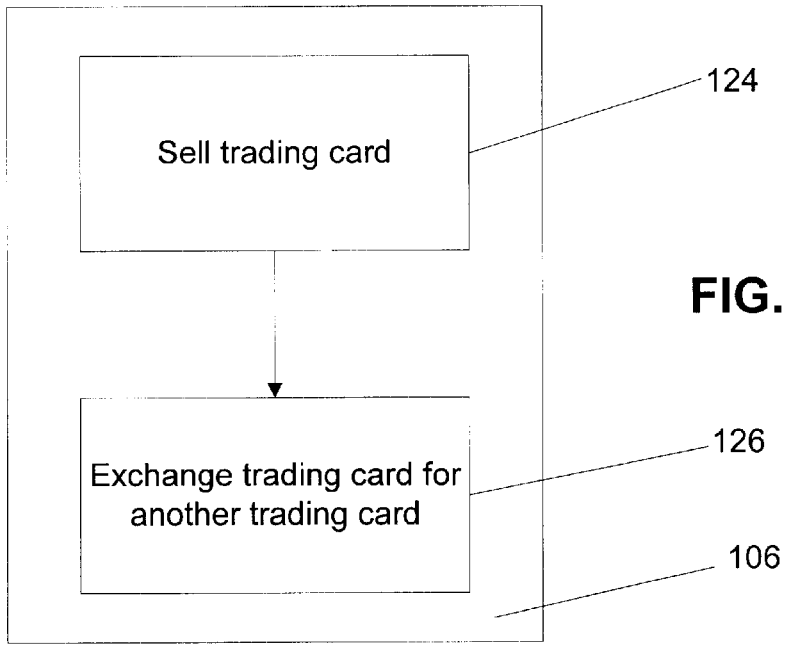
FIG. 4 is a flow chart of the distributing step in FIG. 2 of the present invention.
Figure 5:
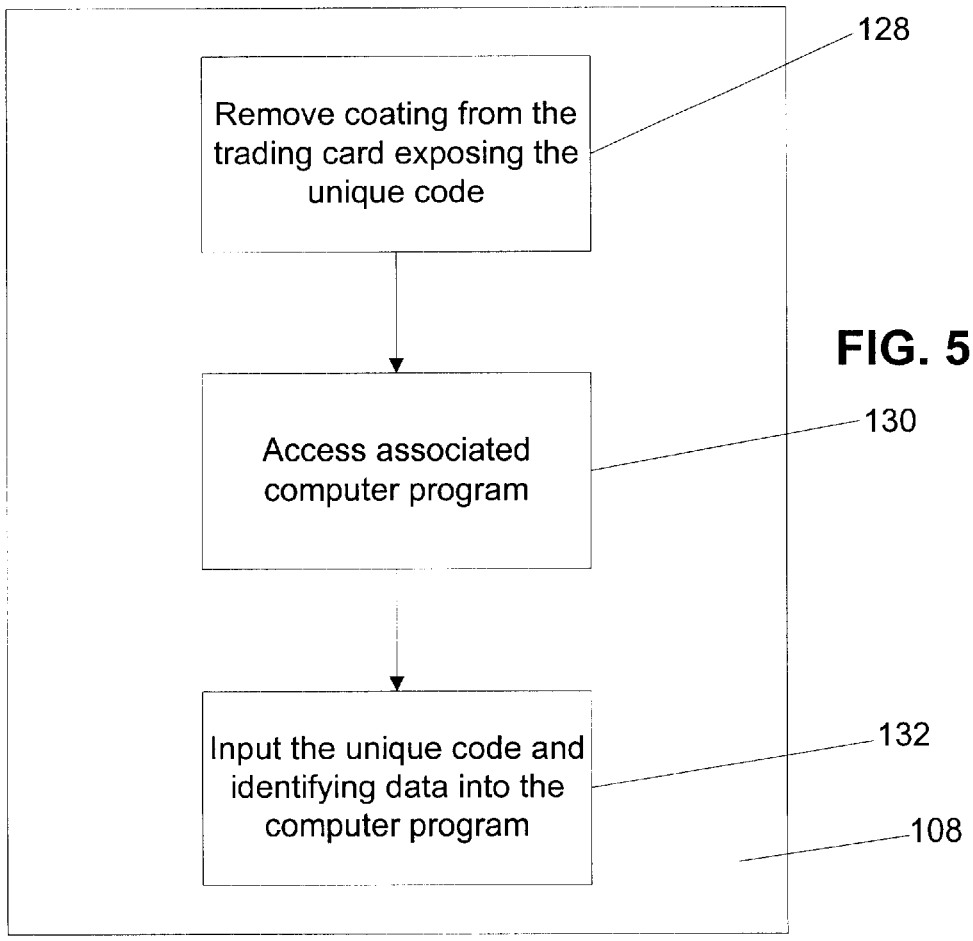
FIG. 5 is a flow chart of the collection and entry step in FIG. 2 of the present invention.

Trading cards 12 may be sold at 124. Trading cards 12 may be exchanged between users similar to the exchange and trading of baseball cards, as shown in FIG. 4 at 126. During initializing step 108, a user who has obtained trading card 12 and who wants to play computer game 10 removes coating 18 from trading card 12 to read unique code 16, as shown in FIG. 5 at 128. The user then accesses the computer program at 130. Access to the computer program may be through Internet connection 34 and entering a web site address or by downloading particular software into computer 14. If the computer program is accessed by Internet connection 34, the program will be a web page. After accessing the web page or other computer program, the user subsequently inputs the readable code using the input device 26 into the computer program, at 132.

Figure 6:
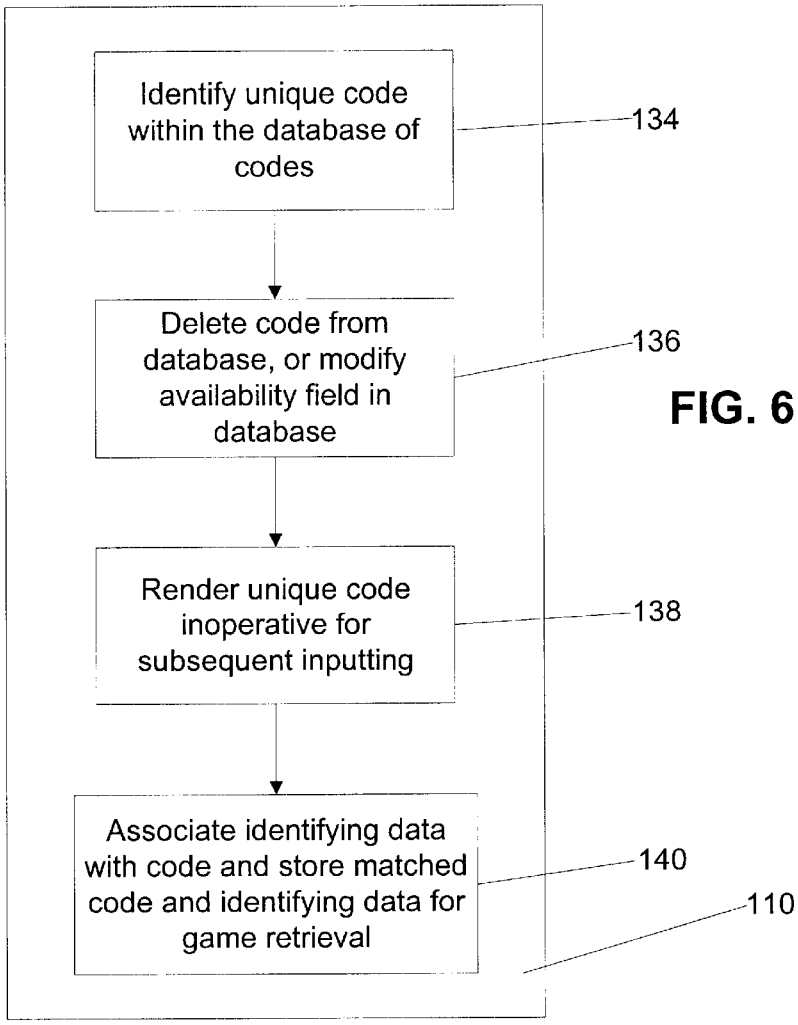
FIG. 6 is a flow chart of the association step in FIG. 2 of the present invention.

Computer game 10 first identifies unique code 16 as a code within the database of available codes, as shown in FIG. 6 at 134. Code 16 may then be deleted from the available field within the database, at 136. Code 16 may then be rendered inoperable for subsequent inputting and use for computer game 10, at 138. Code 16 is optionally stored with the matching user personal identification so that the user may retrieve a prior game, at 140.

Figure 7:
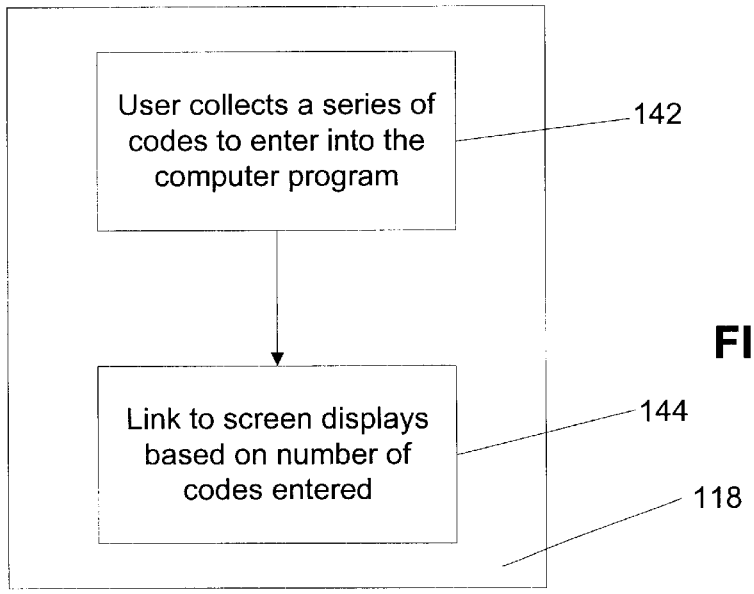
FIG. 7 is a flow chart of the user entry step of FIG. 2 showing input of multiple codes into the present invention.

Additionally, a user may collect a series of cards 12 and hence will collect a number of unique codes 16, as shown in FIG. 7 at 142. The user may enter codes 16 into computer 14. Once the user enters a predetermined number of codes 16 from various trading cards 12, additional computer output 30 may result based on the number of codes entered, as shown in FIG. 7 at 144.

The database and game programming preferably are designed for leveraged use with various product lines. The interaction of the site with the database, and the structure of the individual game pages, preferably is planned to enable a rapid re-purposing, and substitution of a different product line. Elements such as the database design, backend programming, and game play all may be substituted as needed or desired.

A particular application of the program of the present invention is envisioned for use on the Internet. Based on the concept of a scavenger hunt for dinosaur artifacts, the computer program is implemented as part of a website that may feature a wide variety of game play scenarios and environments. The program is designed to extend and enhance the appeal and value of a particular set of collector cards while generating ongoing excitement about the manufacturer of the card and any line of associated goods or services. The site may provide personalized Internet game play as a bonus for each purchase of a particular good or service to enhance the collectability of the cards.

The promotion of the product line includes packaging various dinosaur toys with a collector card and distributing them to consumers. There may be approximately 40 different collector cards overall, each one showing a different dinosaur and at least several different dinosaur toys. Each card is packed with a randomly selected toy, and may no reflect the particular toy dinosaur with which it is packaged, the card may reflect dinosaurs that represent minor characters in a movie. Preferably, the card is not visible in the package, so that the purchaser has no way of knowing what card is in the package.

Each dinosaur trading-style collector card bears a unique identifying "secret code." Once the cardholder registers on the Website, the "secret code" may allow the card collector to gain random access to one of the game-play pages of the site. It may be desired to increase the incentives to purchase multiple products containing the trading cards. Specialty cards may also be marketed. A hologram may be added to a relatively small number of premium cards. The numbers associated with those cards could offer enhanced premium access or benefit, for instance, a showcase game page, movie clip or increased access privileges, such as multiple games, or a previous game with a new level. Codes on the card may also be able to be read using a colored film.

If the user is a first time user, then he or she may be required to register. During this process, demographic information about the user such as age, sex, location, occupation, email, etc., may be collected. The user then may choose or be assigned a password and choose a "personality" from a variety of fun characters. All of this user information may be stored in the User Database. Registration may include collecting demographic information from players, such as the user's assigned identifier number, names, addresses, and other personal identification. This offers the opportunity for direct contact, including mailing discount coupons or other promotional materials and premiums.

If the user is a repeat player, then the user enters his user I.D. and password selected during registration each time the user plays the game. This number may be checked against the User Database. A user may choose to have his user I.D. and password e-mailed to him. Once logged in, the user may be prompted for previously entered or new unique card numbers. This may be checked against the "key database." If the key is valid, the user may be transported to a random area of the game to start, and the area logged in the Transaction Database. During any future login the user may be allowed to return to where he has been before.

Once logged in, the user may see a visual map representing where he has been and where he needs to go on his quest. All movement within the site may be recorded in the Transaction database for that user and key. This may be useful information to a manufacturer, because it may indicate marketing factors such as most popular characters, or products in a story or product line.

Once a card number is used, the database may lock out future play using that code. Purchasing additional merchandise with related trading cards may enable players to visit additional game pages, with increasing rewards for repeat play.

Purchasers who receive duplicate dinosaur cards may wish to trade them for others they lack in their collection. However, the potential recipients may not be able to tell whether the code on the card has been used or not. To help alleviate this problem, the collector cards may utilize a scratch-off coating over the unique coded number. In this way, unused cards (those with the scratch off coating still in place) can be traded as new, retaining their value as unique entry points to the game pages of the associated website.

Throughout the site, a user may be able to save a record of their progress and then access it from any browser. Game play may be random for each user, thus users' experience on the site is unique unto themselves.

Game structure may include a series of scavenger hunts, where the player collects "dinosaur bones" (or other objects, like eggs) to complete a series. The player completes the sequence of pages, and then gets to add the dinosaur completed to a personal "collection" of dinosaurs. The program also may allow a player to download an animated, roaring animation of a completed dinosaur. This would let players collect objects of perceived value that may be obtained only by playing the game. This may lead to an increase in word-of-mouth promotion and communication between players about the game site, ultimately encouraging repeat purchases of trading cards or related toys.

Players' may be assigned a game-play personality. For example, a player may take on the role of an adventurous explorer and fossil hunter. This theme provides a wide variety of graphical and situational opportunities; cases of gear and clothing, scientific equipment, lights, food, radio communications, etc. This theme can be carried through all the game pages. For instance, in board-style game pages, an explorer's jungle hat or coil of rope could be the player's marker, while the player uses a "radio" to receive instructions from "home base."

To add dramatic tension, the program may include a pair of villains, such as a couple of fossil "poachers" who race to get to every "dig" ahead of the player, so that they can "steal" the fossils and take them to a "secret warehouse". When the user visits enough game pages, the user may be rewarded with the chance to try and "rescue" the fossils and return them to the "Dinosaur Museum", the rightful owners. If they succeed, they're given a personalized "Award for Heroism and Good Works" that they can print out or email to their friends.

In the application, navigation within the program may use two paradigms to advance players through the overall site: a standard play mode based on present day travel around the world, and a special premium play mode based on travel back in time.

A map of the world may offer up geographical destinations, sending players to visit different parts of the globe to go on dinosaur "digs" and other related adventures. For example, a player may receive a personalized set of "travel papers" when he logs on. On the next page he may ride a truck up into the mountains of South America, or take a submarine under the South Pole. Once again, the database may track each player through the game pages, ensuring a new game each time each player visits. The value of rewards may be increased as a player advances.

Game play also may include a magical "time machine" to transport the player to a time of "live" dinosaurs. The time machine may navigate dinosaur history with a grinding roar, boring down through the layers of the earth's crust to reach the relics of ancient eras. As the environment transforms to a prehistoric never—never land, animated dinosaurs may provide opportunities for fun, danger and other memorable experiences for fortunate players.

It is not necessary for these games to be historically accurate. Some scenarios may be based partially in fact, while others may spring from pure fantasy. Thus, in some embodiments, a light-hearted approach may be taken to the design of pages, graphics, sounds, and play.

The role of premium games and rewards is to generate excitement and encourage repeat players. There are numerous opportunities to offer premium experiences: special tickets and certificates players can print out or save, animations and movie clips to view and download, increasingly exciting game options based on repeat visits, along with the opportunity to do good, triumph over wickedness and be celebrated as a hero.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A method of playing a computer game having a plurality of game features, comprising:

providing a first trading card and a second trading card wherein the first trading card has a first code hidden by a first removable coating and a second trading card has a second code hidden by a second removable coating;

removing the first removable coating from the first trading card;

inputting the first code into a networked computer program to obtain access to a first game feature of the computer game;

removing the second removable coating from the second trading card;

inputting the second code into the computer program to obtain access to a second game feature of the computer game; and rendering at least one of the first code and the second code inoperable for subsequent inputting into the computer program.

2. The method according to claim 1, wherein the computer program is a web site.

3. The method according to claim 1, further comprising trading at least one of the first trading card and the second trading card prior to removing the coating for the respective card.

4. The method according to claim 1, further comprising inputting personal identification into the computer program prior to inputting the second code into the computer program.

5. The method according to claim 4, further comprising storing the personal identification and the first code in a database to enable reaccess to the first game feature of the computer program.

6. The method according to claim 1, further comprising packaging at least one of the first trading card and the second trading card with a primary product.

7. A computer game, comprising:

at least a first trading card and a second trading card;

a first human-readable code on the first trading card and a second human-readable code on the second trading card;

a removable coating on both the first trading card and the second trading card to conceal the first code and the second code from immediate view;

a networked computer having both an input device and an output device; and a computer program accessible via the networked computer configured to link the first code with a corresponding first output and the second code with a corresponding second output for use with the output device.

8. The computer game according to claim 7, wherein the removable coating is a packaging.

9. The computer game according to claim 7, wherein the removable coating is a scratch-off coating.

10. The computer game according to claim 7, wherein the computer program is a web site.

11. The computer game according to claim 7, further comprising a trademark on the at least one card.

12. The computer game according to claim 7, wherein at least one of the first corresponding output and the second corresponding output includes one of an audio output and a video output.

13. A method of playing a computer game, comprising:

providing a plurality of trading cards that each have a unique code;

collecting a plurality of trading cards;

entering a plurality of unique codes into a website on a networked computer; and producing a computer output based on the number of unique codes entered regardless of the specific unique codes entered.

14. The method of claim 13, wherein the computer output includes an audio output.

15. The method of claim 13, wherein the computer output includes access privileges to specialized web pages.

16. The method of claim 13, wherein the unique code on each trading card is covered with a user-removable coating configured to obscure the unique code from immediate view.

17. The method of claim 13, wherein the user-removable coating is a scratch-off coating.

18. The method of claim 1, wherein the first game feature is a first game page and the second game feature is a second game page.

19. The method of claim 1, wherein the second game feature is a second level to the computer game.

20. The method of claim 1, wherein the first game feature allows entry into the computer game at a first area and the second game feature allows entry into the computer game at a second area.

21. A method of playing a computer game, comprising:

providing a plurality of trading cards, such that each trading card has a unique code configured to provide access to a game feature of a computer game;

providing a web site configured to enable a user to access the computer game;

receiving a first unique code from a first trading card from the user at the web site;

providing a first game feature linked to the first unique code for the computer game;

receiving a second unique code from a second trading card from the user at the web site; and providing a second game feature for the computer game.

22. The method of claim 21, wherein each trading card includes a user-removable coating covering the unique code.

23. The method of claim 22, wherein the user-removable coating is a scratch-off coating.

24. The method of claim 21, further comprising:

tracking progress of the user in playing the computer game; and storing the user's progress in a database.

25. The method of claim 24, further comprising:

receiving user identification and linking the user identification with the user's progress;

subsequently receiving a request for the user's progress by receiving the user identification; and retrieving the computer game based on the user's stored progress.

26. The method of claim 25, wherein the user identification includes a user-selected password.

27. The method of claim 24, wherein the user's progress is stored in a transaction database.

28. The method of claim 21, wherein the game features are game-play pages of the web site configured to be viewed only upon receiving an associated code.

29. The method of claim 21, wherein the game features include movie clips.

30. The method of claim 21 wherein the game features include increased access privileges to different game-play pages on the web site.

* * * * *